US009528349B2

(12) United States Patent
Zimmerman

(10) Patent No.: US 9,528,349 B2
(45) Date of Patent: Dec. 27, 2016

(54) DOWNHOLE POWER GENERATION USING A MUD OPERATED PULSER

(71) Applicant: Halliburton Energy Services, Inc., Houston, TX (US)

(72) Inventor: Mark Zimmerman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 357 days.

(21) Appl. No.: 14/374,622

(22) PCT Filed: Sep. 25, 2013

(86) PCT No.: PCT/US2013/061537
§ 371 (c)(1),
(2) Date: Jul. 25, 2014

(87) PCT Pub. No.: WO2015/047232
PCT Pub. Date: Apr. 2, 2015

(65) Prior Publication Data

US 2015/0260014 A1 Sep. 17, 2015

(51) Int. Cl.
*E21B 41/00* (2006.01)
*E21B 34/06* (2006.01)
*E21B 47/18* (2012.01)

(52) U.S. Cl.
CPC ..... *E21B 41/0085* (2013.01); *E21B 34/06* (2013.01); *E21B 47/18* (2013.01)

(58) Field of Classification Search
CPC .... E21B 47/18; E21B 41/0085; E21B 47/182; E21B 47/185; E21B 47/187
See application file for complete search history.

(56) References Cited

U.S. PATENT DOCUMENTS 5,117,398 A * 5/1992 Jeter ..... E21B 47/187 367/85
5,839,508 A 11/1998 Tubel et al.
(Continued)

FOREIGN PATENT DOCUMENTS

| | | | |
|---|---|---|---|
| CN | 2787829 | Y | 6/2006 |
| WO | 02072993 | A2 | 9/2002 |
| WO | 2015047232 | A1 | 4/2015 |

OTHER PUBLICATIONS

International Search Report and Written Opinion for PCT/US2013/061537 dated Jun. 26, 2014.

*Primary Examiner* — Blake Michener
*Assistant Examiner* — Manuel C Portocarrero
(74) *Attorney, Agent, or Firm* — McDermott Will & Emery LLP; Alan Bryson

(57) ABSTRACT

The present disclosure relates to generating electricity downhole using a mud-operated pulser. A disclosed example embodiment of a mud pulser system includes a piston assembly movably disposed within a housing, comprising a power piston, and configured to move in response to a pressure from a fluid flow, a control valve having an open state, in which the power piston receives the fluid flow, and a closed state, in which the power piston does not receive the fluid flow, a magnet disposed on the housing or the piston assembly, and a coil disposed on the housing or the piston assembly, wherein the magnet is configured to displace relative to the coil in response to movement of the piston assembly within the housing, such that relative movement of the magnet and the coil generates electrical energy.

19 Claims, 4 Drawing Sheets

(56) References Cited

U.S. PATENT DOCUMENTS

| | | | | |
|---|---|---|---|---|
| 5,965,964 | A * | 10/1999 | Skinner | E21B 41/0085 310/12.04 |
| 7,145,834 | B1 | 12/2006 | Jeter | |
| 7,242,103 | B2 | 7/2007 | Tips | |
| 7,423,932 | B1 * | 9/2008 | Jeter | E21B 41/0085 175/40 |
| 2008/0179093 | A1 * | 7/2008 | Kusko | E21B 47/187 175/40 |
| 2008/0271923 | A1 * | 11/2008 | Kusko | E21B 4/02 175/25 |

* cited by examiner

DOWNHOLE POWER GENERATION USING A MUD OPERATED PULSER

BACKGROUND

The present disclosure relates to downhole power generation and, more particularly, to generating electricity downhole using a mud operated pulser.

A wide variety of downhole well tools may be utilized which are electrically powered. For example, flow control devices, sensors, samplers, packers, instrumentation within well tools, telemetry devices, and well logging devices may all use electricity in performing their respective functions.

In the past, the most common methods of supplying electrical power to well tools were use of batteries and electrical lines extending to a remote location, such as the earth's surface. Unfortunately, some batteries cannot operate for an extended period of time at downhole temperatures, and those batteries that are able to operate downhole temperatures must still be replaced periodically. Moreover, electrical lines extending for long distances downhole can interfere with flow or access if they are positioned within a tubing string, and they can be damaged if they are positioned inside or outside of the tubing string.

Power can be generated downhole by using the circulating drilling fluid or "mud" to operate a downhole generator or turbine. Mud flow rates can vary widely and downhole generators and turbines may be adversely affected when the flow rate becomes excessively high. For example, at high flow rates the increased rotational rate produces high torques within the downhole generator or turbine. In addition, at high flow rates, more power can be generated than is necessary for the intended application, thereby leading to heat production.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole power generation and, more particularly, generating electricity downhole using a mud operated pulser.

The embodiments disclosed herein take advantage of energy already present in circulating drilling mud to generate electrical power. An amount of power generated downhole may exceed an amount of power consumed by selected components. Excess amounts of power may be stored or used by other components. The drilling mud is circulated through a modified mud pulser system equipped with corresponding magnet and coil assemblies that generate electricity as the mud pulser system oscillates or reciprocates during operation. Accordingly, the present disclosure uses the same operational principles of conventional mud pulsers to additionally generate electrical power. As a result, no mechanical regulation is needed for power generation downhole, and the mechanical strength and excess power production are not problematic, since the modified mud pulser system does not directly rely upon the flow of drilling mud therethrough to generate electrical power.

Figure 1:
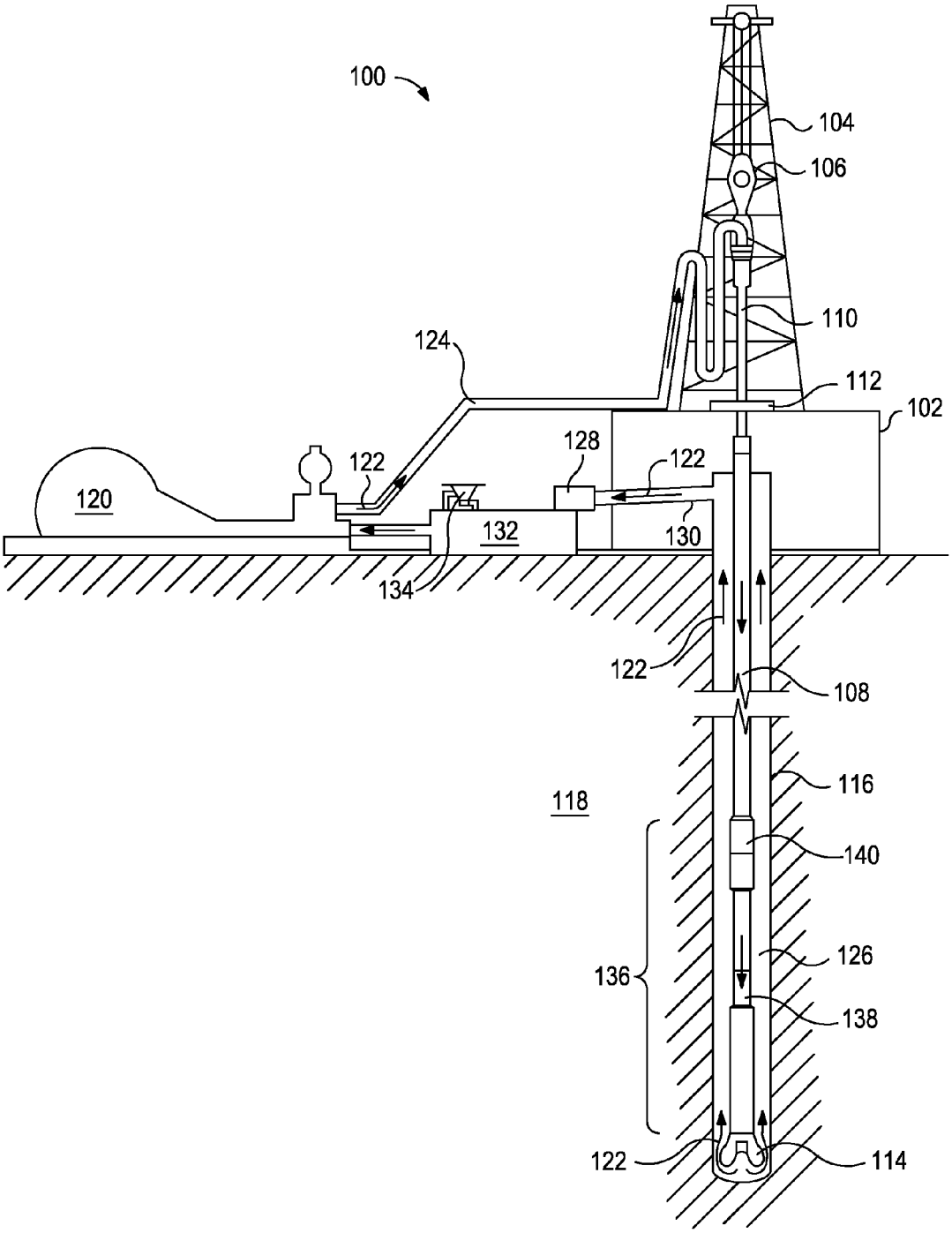
FIG. 1 illustrates an exemplary drilling system that may employ the principles of the present disclosure.

Referring to FIG. 1, illustrated is an exemplary drilling system 100 that may employ the principles of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling system 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the drill bit 114 rotates, it creates a borehole 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the borehole 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a cleaned drilling fluid 122 is deposited into a nearby retention pit 132 (i.e., a mud pit). One or more chemicals, fluids, or additives may be added to the drilling fluid 122 via a mixing hopper 134 communicably coupled to or otherwise in fluid communication with the retention pit 132.

The drilling system 100 may further include a bottom hole assembly (BHA) 136 arranged in the drill string 108 at or near the drill bit 114. The BHA 136 may include any of a number of sensor modules 138 (one shown) which may include formation evaluation sensors and directional sensors, such as measuring-while-drilling and/or logging-while-drilling tools. These sensors are well known in the art and are not described further. The BHA 136 may also contain a mud pulser system 140 (hereinafter "mud pulser 140") which induces pressure fluctuations in the mud flow. Data from the downhole sensor modules 138 are encoded and transmitted to the surface via the mud pulser 140 whose pressure fluctuations or pulses propagate to the surface through the column of mud flow in the drill string 108. At the surface the pulses are detected by one or more surface sensors (not shown), such as a pressure transducer, a flow transducer, or a combination of a pressure transducer and a flow transducer.

Referring to FIGS. 2 and 3A-3D, with continued reference to FIG. 1, illustrated is an exemplary embodiment of the mud pulser 140, according to one or more embodiments.

The mud pulser 140 is a powered hydraulic amplifier and uses forces and pressures generated by drilling fluid ("mud") flowing past the tool to generate a mud pulse that is capable of generating electrical power.

Fluid may be received at one end of the mud pulser 140. This end may generally face in the uphole direction (i.e., towards the surface of the well), where the drilling fluid is introduced into the wellbore. The fluid surrounding the mud pulser 140 may be mud being pumped down the drill string 108 (FIG. 1) to the bit 114 (FIG. 1). The pressure of the mud is attributable to the surface pumps pushing against the resistance encountered at the bit 114 and also the fluid hydrostatic pressure created by the fluid column within the drill string 108. In other embodiments, the mud pulser 140 may face downhole where a fluid may be pumped out of the wellbore.

Figure 2:
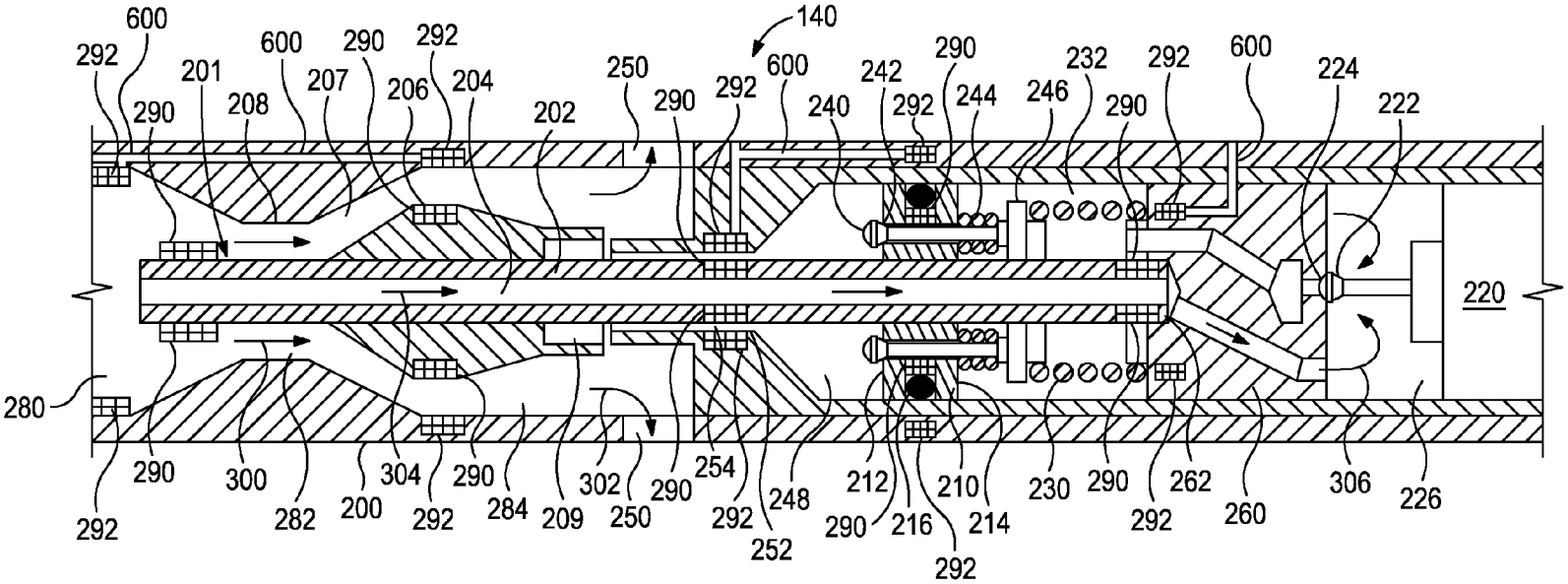
FIG. 2 illustrates an exemplary embodiment of the mud pulser of FIG. 1, according to one or more embodiments.

A piston assembly 201 of the mud pulser 140 includes a poppet 206, a shaft 202, and a power piston 210 with one or more relief valves 240. The piston assembly 201 is configured to move axially in a reciprocating or oscillatory motion. The reciprocating motion of the piston assembly 201 facilitates power generation by a power generation unit. For example, reciprocating motion of the piston assembly 201 causes relative motion of at least one magnet 290 of the power generation unit through at least one coil 292 of the power generation unit. As shown in FIG. 2, one or more magnets 290 may be located on the shaft 202. Other locations of the magnets 290 are contemplated, including, but not limited to, at or near the poppet 206, the flow line orifice 208, a flow shroud 252, the power piston 210, the barrier 260, the seat 262, or arranged based on combinations of the above. One or more coils 292 may be provided at an axial location at or near each location of the magnets 290. Those skilled in the art will readily appreciate that the positions of the magnets 290 and coils 292 could be reversed. Other types of power generation units may be used without departing from the scope of the present disclosure.

The coils 292 may be connected to various well tools via lines 600. The lines 600 could be positioned within the housing 200 or along a surface of a wall of the housing 200. The lines 600 may extend beyond the mud pulser 140 to other components of or connected to the BHA 136 (FIG. 1). Lines 600 from one or more coils 292 may converge or remain separate. Alternatively, well tools receiving power from the coils 292 may be integrally formed therewith, thus removing any need for lines 600.

As the magnets 290 move relative to the coils 292, electrical power is generated in the coils 292. Since the piston assembly 201 displaces axially relative to the housing 200, alternating polarities of electrical power are generated in the coils 292 and, thus, the generating device produces alternating current. This alternating current may be converted to direct current, if desired, using techniques well known to those skilled in the art. Electrical power generated by the motion of the piston assembly 201 may be stored in a power source (not shown) or directly provided to components of the BHA 136 (FIG. 1), such as flow control devices, sensors, samplers, packers, instrumentation within well tools, telemetry devices, well logging devices, etc. Power may be provided to components of another well tool, such as a control modules, actuators, etc. for operating another well tool. Power may also be provided to batteries or another device to store electrical power for operating well tools. Power may also be provided to a flow control device, such as a sliding sleeve valve or variable choke or a safety valve.

The piston assembly 201 is configured to travel axially within a housing 200. The mud pulser 140 further includes a flow line orifice 208 which, in conjunction with the poppet 206, opens and closes to control the actuation of the piston assembly 201. The mud pulser 140 generates a positive pressure pulse by temporarily restricting the flow of mud through the mud column. The mud pulser 140 exploits the drop in potential energy of mud flowing across the flow line orifice 208 to force the poppet 206 into the flow line orifice 208.

The poppet 206 and the flow line orifice 208 may be of a durable material, such as tungsten carbide, and provide opposing faces that are ground to a smooth finish to help the poppet 206 seal properly. In at least one embodiment, the face of the poppet 206 opposing the flow line orifice 208 is ground at an oblique angle (e.g., 70°) to a centerline to increase the flow line gap 207 while in an open position and provide sufficient sealing area when closed.

As situated within the drill string 108 (FIG. 1), the mud pulser 140 diverts a portion of the main flow of mud from the upstream region 280 into the housing 200 of the mud pulser 140 as a flow 300 and a flow 304. As illustrated, the flow 300 is received from an upstream region 280 through the flow line orifice 208. The flow line orifice 208 defines an opening 282 having a cross-sectional area less than the upstream region 280 upstream of the opening 282 and/or less than a downstream region 284 downstream of the opening 282. The downstream region 284 may have a cross-sectional area that is at least partially occupied by a portion of the poppet 206. The open space for fluid flow is defined by the flow line gap 207. The flow 300 is directed to the flow line gap 207 between at least a portion of the flow line orifice 208 and the poppet 206. Fluid flowing through the flow line orifice 208 at flow 300 undergoes a partial transformation from potential energy (higher pressure) to kinetic energy (higher velocity), thus developing a pressure differential across the flow line orifice 208. As such, a pressure at the opening 282 and/or the downstream region 284 is lower than a pressure at the upstream region 280.

The flow 300 is further directed, as flow 302, through the downstream region 284 to one or more exits 250. The exits 250 are provided, for example, as apertures or sidewall openings through the housing 200. In some embodiments, the exits 250 may be provided about a majority (e.g., 51-99%) of a circumferential span of the housing 200. The exits 250 provide fluid communication from an interior portion of the mud pulser 140 to a region exterior to the mud pulser 140 (i.e., from within the housing 200 to the exterior of the housing 200).

The mud pulser 140 also directs the flow 304 through a conduit 204 of the shaft 202. The pressure at the upstream region 280 is transferred through a conduit 204 defined longitudinally in the shaft 202. The flow 304 is directed, as flow 306, to a control chamber 226. Regardless of the axial position of the shaft 202, the conduit 204 remains in direct fluid communication with the control chamber 226. The control chamber 226 is in selective fluid communication with a second piston chamber 232 via a control valve 224.

A barrier 260 is provided between the control chamber 226 and the second piston chamber 232. A shaft seat 262 defined in the barrier 260 receives a distal end of the shaft 202. The conduit 204 maintains direct fluid communication with the control chamber 226 throughout operation. As shown in FIGS. 3A-3D, as the shaft 202 moves axially with respect to the housing 200, the distal end of the shaft 202 moves within the seat 262 while remaining at least partially engaged therein.

A control valve 222 is operated by a control assembly 220. In some embodiments, the control assembly 220 may include a solenoid-operated spring return pilot valve for opening and closing the control valve 222. In other embodiments, other mechanisms for controllably operating the control valve 222 may be provided, without departing from the scope of the present disclosure. For example, the control valve 222 may be a hydraulic valve, a pneumatic valve, a mechanical valve, an electromechanical valve, any combination thereof, and the like. In at least one embodiment, the control assembly 220 may be powered by an adjacent power source (not shown). In other embodiments, the electrical power of the control assembly 220 may be replenished based on the operation of the mud pulser 140.

The control valve 222 controllably provides or prevents fluid communication between the control chamber 226 and the second piston chamber 232. In this particular embodiment, the control valve 222 is alternately movable between an open state (FIGS. 3B and 3C), which opens a fluid flow 308 to the power piston 210, and a closed state (FIGS. 3A and 3D), which closes the fluid flow 308 to the power piston 210, at least to the extent that a pressure of the fluid flow 308 is insufficient to move the power piston 210 appreciably. When the control valve 222 is in the open state, a second side 214 of the power piston 210 is in fluid communication with the upstream region 280 and exposed to the pressure from the fluid flow 308. The piston assembly 201 is freely movable within the housing 200 in a first axial direction in response to the fluid flow 308 when the control valve 222 is in the opened state and in a second axial direction, opposite the first axial direction, in response to pressure from the downstream region 284 and in the absence of fluid flow 308 when the control valve 222 is in the closed state.

Figure 3A:
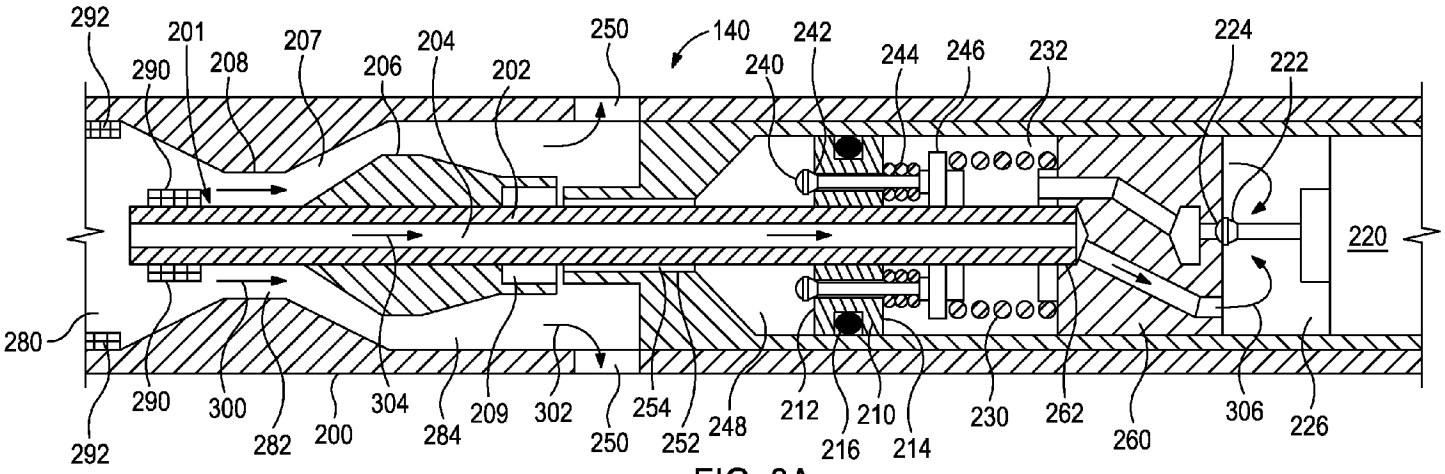
FIG. 3A illustrates an exemplary embodiment of the mud pulser of FIG. 1, according to one or more embodiments.
Figure 3B:
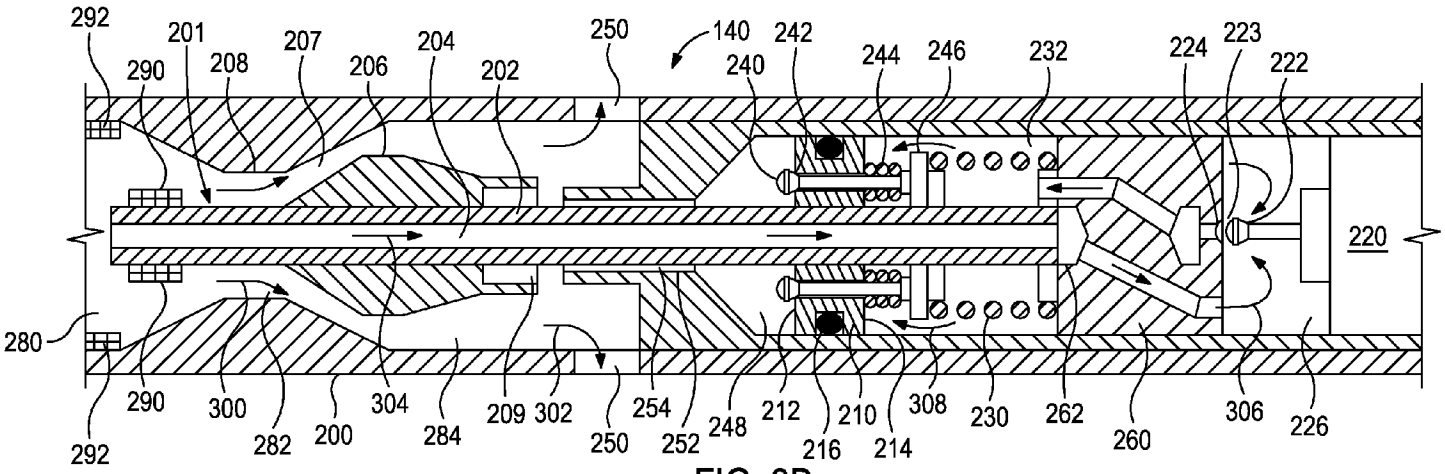
FIG. 3B illustrates an exemplary embodiment of the mud pulser of FIG. 1, according to one or more embodiments.
Figure 3C:
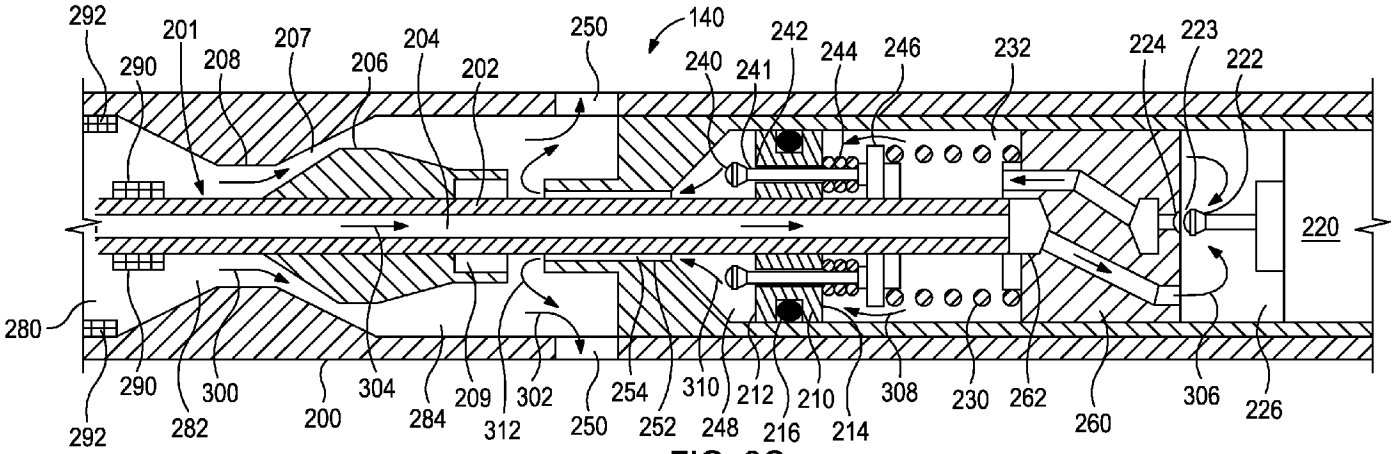
FIG. 3C illustrates an exemplary embodiment of the mud pulser of FIG. 1, according to one or more embodiments.

When the coil of the control assembly 220 is energized, it creates an electromagnetic field that pulls in a solenoid plunger against a spring load, thus causing the control valve 222 to move away from the control seat 224 and create a control opening 223 (FIGS. 3B and 3C). When the field is allowed to dissipate, the spring load overcomes any remaining magnetic force and pushes the control valve 222 against the control seat 224.

The control valve 222 may be opened and closed based on one or more of a variety of criteria. In some embodiments, for example, the control valve 222 may be opened when the pressure within the control chamber 226 is equal to or substantially equal to the pressure at the upstream region 280. The control valve 222 may be closed when the pressure within the control chamber 226 is lower than the pressure at the upstream region 280 or lower by a predetermined margin.

In some embodiments, the control valve 222 may be opened when a position of the power piston 210—or another component of the piston assembly 201—achieves a first, non-actuated position. The control valve 222 may be closed when the power piston 210—or another component of the piston assembly 201—achieves a second, actuated position. A position of the piston assembly 201 may be detected by a linear Hall Effect circuit in which a current is induced by motion of a magnet on the piston assembly 201. This function may be provided by the magnet 290 and the coils 292, or by another pairing of magnets and coils. In some embodiments, the control valve 222 may by operated in a manner that limits, controls, or determines the amount of electrical power or voltage that is generated in the coil(s) 292. For example, the control assembly 220 may sense or monitor the output of electrical power generated in the coil(s) 292 and adjust operation of the control valve 222 to increase or decrease the power output to achieve a desired output.

The power piston 210 is coupled to the shaft 202 for axial reciprocating motion within an internal portion of the mud pulser 140. A first side 212 of the power piston 210 faces a first piston chamber 248. A second side 214 of the power piston 210 faces or is otherwise exposed to a second piston chamber 232. The power piston 210 divides the first piston chamber 248 from the second piston chamber 232. The power piston 210 may sealingly engage a portion of the housing 200 with a seal 216 to provide fluid isolation between the first and second piston chambers 248, 232 as the power piston 210 moves axially.

The first piston chamber 248 remains in fluid communication with the downstream region 284 throughout operation of the mud pulser 140 via the flow shroud 252. More particularly, the flow shroud 252 defines a flow channel 254 for fluidly connecting the first piston chamber 248 with the downstream region 284.

With reference to FIG. 3B, when the control valve 222 is open, the second piston chamber 232 is brought into fluid communication with the control chamber 226, the conduit 204, and the upstream region 280. Moreover, when the control valve 222 is open, a flow 308 of fluid is directed to the second side 214 of the power piston 210.

With the control valve 222 in the open position, the second piston chamber 232 is in fluid communication with the upstream region 280 and the first piston chamber 248 remains in fluid communication with the downstream region 284. Accordingly, a pressure differential that occurs across the flow line orifice 208 (from the upstream region 282 to the downstream region 284) is substantially equal to a pressure differential that occurs across the power piston 210. In response to this pressure differential, the power piston 210 may be urged to move axially, thereby moving the piston assembly 201, including the shaft 202 and the poppet 206.

The power piston 210 provides a cross-sectional area that is greater than a cross-sectional area of the poppet 206. For example, a maximum cross-sectional area of the power piston 210 may be about 10%, 20%, 30%, 40%, 50%, or 60% greater than a maximum cross-sectional area of the poppet 206. Accordingly, a force acting directly on the power piston 210, in a direction of the poppet 206, is greater than a force acting directly on the poppet 206, in a direction of the power piston 210. The greater cross-sectional area of the power piston 210 results in a larger force even in view of forces acting resulting from a momentum change of fluid (e.g., mud) as it hits the poppet 206 and pressure losses encountered along flow 304 and flow 306 between the upstream region 280 and the control chamber 226. Because the power piston 210 and the poppet 206 are each connected to the shaft 202, forces acting on each are transmitted to the other via the shaft 202. The fluid force applied to the second side 214 of the power piston 210 is greater than the fluid force applied to the poppet 206 when the control valve 222 is open. The fluid force applied to the poppet 206 is greater than the fluid force applied to the second side 214 of the power piston 210 when the control valve 222 is closed.

A starter spring 230 is provided between the barrier 260 and an annular ring 246 arranged within the second piston chamber 232. Other configurations are contemplated, such as anchoring the starter spring 230 to another component of the housing 200 and/or directly to the power piston 210. The annular ring 246 is connected to the shaft 202, such that forces provided by the starter spring 230 to the annular ring 246 are transmitted to the poppet 206. The starter spring 230 provides a force that biases the poppet 206 toward the flow line orifice 208, thereby creating an initial pressure drop across the flow line orifice 208 by restricting the mud flow through the flow line orifice 208. At low flow rates, this initial pressure drop helps the power piston 210 overcome frictional and head losses.

With reference to FIGS. 3B-3C, the one or more relief valves 240 (two shown) may controllably separate the first piston chamber 248 from the second piston chamber 232. Each relief valve 240 is selectively positioned in a seat 242 that may be of a durable material, such as tungsten carbide, to resist erosion. The relief valves 240 provide fluid communication between the first piston chamber 248 from the second piston chamber 232, thereby enabling the power piston 210 to return to a non-actuated position. Each relief valve 240 may be operated by a relief spring 244 that biases each relief valve 240 to a closed position within the seat 242.

When the control valve 222 opens and the piston 210 starts to move up on pulse, the relief valves 240 mounted on the power piston 210 serve to regulate the pulse amplitude. For example, the relief valves 240 open when the pressure differential across the power piston 210 reaches the cracking pressure of the relief valve 240.

As shown in FIG. 3B, the relief valves 240 are closed when the pressure differential across the power piston 210 is below the cracking pressure (e.g., when the control valve 222 is closed). As shown in FIG. 3C, however, the relief valves open to form a relief gap 241 when the pressure differential across the power piston 210 exceeds the cracking pressure. When opened, the relief valve 240 slows or arrests the translation of the power piston 210 and the poppet 206. The stiffness of the relief springs 244 determines the pulse height by limiting the maximum differential pressure across the power piston 210.

As further shown in FIG. 3C, a flow 310 is permitted from the second piston chamber 232 to the first piston chamber 248 upon opening the relief valves 240. The flow 310 from the first piston chamber 248 continues through the flow channel 254 defined by the flow shroud 252. As mentioned above, the flow channel 254 fluidly connects the first piston chamber 248 and the downstream region 284. From the flow channel 254, a flow 312 joins with the flow 302 and the downstream region 284 and is able to exit the housing 200 via the exits 250. The flow 312 may interact with at least a portion of the poppet 206. For example, the poppet 206 may include a recess 209 facing the flow shroud 252, such that the flow 312 from the flow channel 254 is directed at least partially into the recess 209.

The relief valves 240 regulate the pulse height of the pressure wave produced by the poppet 206 and the flow line orifice 208. The relief valves 240 also allow the mud pulser 140 to produce more consistent pulse maximum heights over the entire flow range of the mud pulser 140, which reduces erosion in the control valve 222. The pressure at which the valves 240 open is determined by the preload of the relief springs 244. The relief valves 240 may include intermittently exercised pop off valves to continuously open the relief valves 240. The relief valves 240 may be cycled each time the mud pulser 140 produces a pulse.

The pulse amplitude range for a mud pulser 140 starts at a factor of the cracking pressure of the relief valves 240. The factor is about equal to the ratio of the cross-sectional area of the power piston 210 to the cross-sectional area of the poppet 206. For example, where the cross-sectional area of the power piston 210 is 40% greater than the cross-sectional area of the poppet 260, the pulse amplitude range is 40% greater than the cracking pressure of the relief valves 240. The pulse amplitude seen at the surface may be less than that measured at the mud pulser 140 because of signal attenuation occurring as the pressure wave travels up the drill string. Tools that run at deeper total depths are more susceptible to signal attenuation than in tools that run at shallower depths.

Figure 3D:
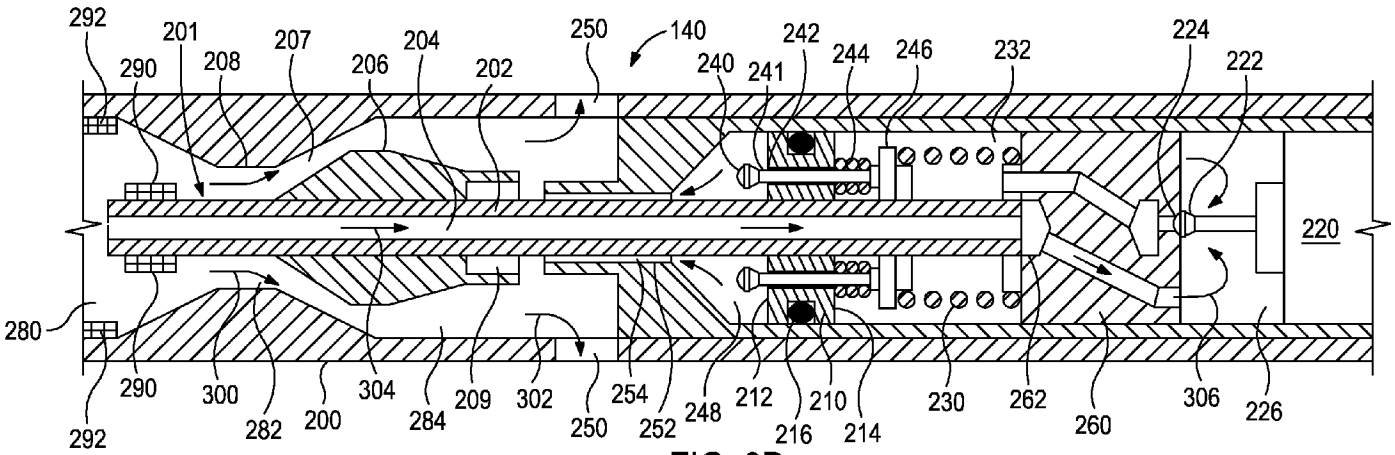
FIG. 3D illustrates an exemplary embodiment of the mud pulser of FIG. 1, according to one or more embodiments.

The relief valves 240 may be configured to prevent the poppet 206 from entirely blocking the flow line orifice 208 during each pulse cycle, which would provide enormous pressure pulses and very high flow velocities through the flow line gap 207. In addition, as shown in FIG. 3D, the relief valves 240 allow the power piston 210 to return to a non-actuated position after a pulse by bleeding fluid (e.g., mud) through the relief valves 240. Accordingly, the relief valves 240 allow the pressure differential across the power piston 210 to be returned at least to the cracking pressure of the relief valve 240. The flow 310 may be permitted from the second piston chamber 232 to the first piston chamber 248.

In exemplary operation, the mud pulser 140 receives a flow from the upstream region 280. In the pulse off condition, as shown in FIG. 3A, the flow 300 passes through the flow line orifice 208, pushing the poppet 206 down against the starter spring 230. A pressure drop occurs across the flow line orifice 208. From the upstream region 280, high pressure creates a flow 304 that is provided through the conduit 204 to the control chamber 226. The control chamber 226 has an outlet that is sealed by the control valve 222 and is at a higher pressure than at the downstream region 284. When the control valve 222 is in the closed position, the force of the flow 300 maintains the poppet 206 in a pulse off position.

As shown in FIG. 3B, as the control assembly 220 activates the control valve 222, fluid is allowed to enter the second piston chamber 232 and pushes the power piston 210 forward. The forward axial motion of the piston assembly 201 causes an electrical current to be induced in a coil 292. The power piston 210 is connected to the main poppet 206 by the shaft 202. As the power piston 210 moves forward, it causes the poppet 206 to move up into the flow line orifice 208 and cause a flow restriction (pulse on) in the flow line gap 207. This restriction may be detectable as a pressure pulse on the surface.

As shown in FIG. 3C, and as described above, the amount of high pressure that can be developed is controlled by the relief valves 240 riding on the power piston 210. At a specific pressure, the relief valves 240 open to prevent the poppet 206 from advancing further. In this manner, the pulse amplitude is controlled over a wide flow range.

As shown in FIG. 3D, when the control assembly 220 is de-energized, the control valve 222 closes and arrests the flow 308 of drilling fluid to the second side 214 of the power piston 210. The power piston 210 no longer receives sufficient force to hold it in the "pulse on" position. The flow 300 of fluid in the flow line gap 207 past the poppet 206 forces the piston assembly back in to the "pulse off" position. The rearward axial motion of the piston assembly 201 also causes an electrical current to be induced in the coil 292.

The control valve 222 is opened and closed repeatedly on demand. The resulting reciprocation of the piston assembly 201 generates electrical energy as disclosed herein. Electrical energy generated by the axial motion of the piston assembly 201 may be stored or used as needed within or by components of the BHA 136, including the mud pulser 140.

The mud pulser 140 may also include a communication link between the tool string and surface equipment. A telemetry system transmits data between mud pulser 140 and a surface system (not shown). A communication link may be established by superimposing small pressure pulses onto the column of circulating fluid in the drill pipe. These pressure pulses, which represent encoded information from the downhole electronic tool sections, can be detected and decoded by the surface system. The downhole system takes periodic measurements from sensors and relays this information to the surface system.

Embodiments disclosed herein include:

A. A mud pulser system that includes a piston assembly movably arranged within a housing and configured to move based on operation of a control valve, a magnet arranged on one of the housing and the piston assembly, and a coil arranged on one of the housing or the piston assembly, wherein the magnet is configured to displace relative to the coil in response to movement of the piston assembly within the housing, such that relative movement of the magnet and the coil generates electrical energy.

B. A method that includes receiving a first flow from an upstream region through a flow line orifice and past a poppet of a piston assembly to a downstream region, receiving a second flow from the upstream region to a control valve, opening the control valve, such that the piston assembly moves in a first axial direction, closing the control valve, such that the piston assembly moves in a second axial direction, opposite the first axial direction, and generating electrical power by axial movement of the piston assembly.

C. A mud pulser system that includes a housing having a flow line orifice with a cross-sectional area less than a cross-sectional area of an upstream region disposed upstream of the flow line orifice and a downstream region disposed downstream of the flow line orifice, a piston assembly configured to move axially within the housing and comprising (i) a shaft having a conduit fluidly connecting the upstream region with a control chamber; (ii) a poppet attached to the shaft, at least partially disposed in the downstream region, and defining a flow line gap between the poppet and the flow line orifice; and (iii) a power piston separating a first piston chamber, in fluid communication with the downstream region, from a second piston chamber, a control valve configured to permit fluid communication between the second piston chamber and the control chamber in an open state and prevent fluid communication between the second piston chamber and the control chamber in a closed state, and a power generation unit comprising a magnet and a coil configured to achieve relative axial motion based on axial motion of the piston assembly.

Each of embodiments A, B, and C may have one or more of the following additional elements in any combination: Element 1: wherein the magnet is arranged at a poppet of the piston assembly and the coil is disposed at a flow line orifice of the housing. Element 2: wherein the magnet is arranged at a power piston of the piston assembly. Element 3: wherein the magnet is arranged at a shaft of the piston assembly and the coil is disposed at a flow shroud of the housing, the flow shroud being disposed axially between a poppet of the piston assembly and a power piston of the piston assembly. Element 4: wherein the control valve is configured to controllably place a side of a power piston of the piston assembly in fluid communication with an upstream region of the housing. Element 5: wherein the piston assembly is configured to move in a first axial direction when the control valve is opened and in a second axial direction, opposite the first axial direction, when the control valve is closed.

Element 6: wherein generating electrical power comprises moving a magnet and a coil relative to each other to induce a current within the coil. Element 7: wherein opening the control valve comprises exposing a first side of a power piston to a pressure from the upstream region. Element 8: wherein the control valve opens when the poppet achieves a first position and wherein the control valve closes when the poppet achieves a second position, axially closer to the flow line orifice than the first position. Element 9: wherein closing the control valve comprises isolating a first side of a power piston of the piston assembly from a pressure from the upstream region. Element 10: wherein, when the control valve is open, a pressure differential across a power piston of the piston assembly is equal to the pressure differential across the flow line orifice. Element 11: further comprising storing the electrical power. Element 12: further comprising providing the electrical power to a tool of a bottom hole assembly.

Element 13: wherein a pressure at the upstream region is greater than a pressure at the downstream region. Element 14: wherein the poppet is configured to move axially towards the flow line orifice when the control valve is opened. Element 15: wherein the piston assembly is configured to move axially away from the flow line orifice when the control valve is closed. Element 16: wherein the magnet is arranged at a poppet of the piston assembly and the coil is disposed at a flow line orifice of the housing.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A mud pulser system, comprising:

a piston assembly movably disposed within a housing and including a power piston, the piston assembly being configured to move in response to pressure from a fluid flow;

a control valve having an open state, in which the power piston receives the fluid flow, and a closed state, in which fluid flow is prevented from interacting with the power piston;

a magnet disposed on one of the housing and the piston assembly; and a coil disposed on the other of the housing and the piston assembly, wherein the magnet is configured to displace relative to the coil in response to movement of the piston assembly within the housing, such that relative movement of the magnet and the coil generates electrical energy.

2. The mud pulser system of claim 1, wherein the piston assembly further comprises a poppet and the housing comprises a flow line orifice disposed upstream of the power piston, the piston assembly being movably disposed within the flow line orifice, and wherein the magnet is disposed at the poppet and the coil is disposed at the flow line orifice of the housing.

3. The mud pulser system of claim 2, wherein the piston assembly further comprises a shaft disposed axially between the poppet and the power piston and the housing further comprises a flow shroud, wherein the shaft is movably disposed within the flow shroud, and wherein the magnet is disposed at the shaft of the piston assembly and the coil is disposed at the flow shroud of the housing.

4. The mud pulser system of claim 1, wherein the magnet is disposed at the power piston of the piston assembly.

5. The mud pulser system of claim 1, wherein, when the control valve is in the open state, a side of the power piston of the piston assembly is exposed to the pressure from the fluid flow.

6. The mud pulser system of claim 1, wherein the piston assembly is configured to move in a first axial direction when the control valve is in the open state and in a second axial direction, opposite the first axial direction, when the control valve is in the closed state.

7. A method of generating electrical power downhole with a mud pulser system, comprising:

receiving, by the mud pulser system, a first flow from an upstream region through a flow line orifice and past a poppet of a piston assembly to a downstream region;

receiving a second flow from the upstream region to a control valve;

opening the control valve, such that the piston assembly moves in a first axial direction;

closing the control valve, such that the piston assembly moves in a second axial direction, opposite the first axial direction; and generating electrical power by axial movement of the piston assembly.

8. The method of claim 7, wherein generating electrical power comprises moving a magnet and a coil relative to each other to induce a current within the coil.

9. The method of claim 7, wherein opening the control valve comprises exposing a first side of a power piston to a pressure from the upstream region.

10. The method of claim 7, wherein the control valve opens when the poppet achieves a first position and wherein the control valve closes when the poppet achieves a second position, axially closer to the flow line orifice than the first position.

11. The method of claim 7, wherein closing the control valve comprises isolating a first side of a power piston of the piston assembly from a pressure from the upstream region.

12. The method of claim 7, wherein, when the control valve is open, a pressure differential across a power piston of the piston assembly is equal to the pressure differential across the flow line orifice.

13. The method of claim 7, further comprising storing the electrical power.

14. The method of claim 7, further comprising providing the electrical power to a tool of a bottom hole assembly.

15. A mud pulser system, comprising:

a housing having a flow line orifice with a cross-sectional area less than a cross-sectional area of an upstream region disposed upstream of the flow line orifice and a downstream region disposed downstream of the flow line orifice;

a piston assembly configured to move axially within the housing and comprising (i) a shaft having a conduit fluidly connecting the upstream region with a control chamber; (ii) a poppet attached to the shaft, at least partially disposed in the downstream region, and defining a flow line gap between the poppet and the flow line orifice; and (iii) a power piston separating a first piston chamber, in fluid communication with the downstream region, from a second piston chamber;

a control valve configured to permit fluid communication between the second piston chamber and the control chamber in an open state and prevent fluid communication between the second piston chamber and the control chamber in a closed state; and a power generation unit comprising a magnet and a coil configured to achieve relative axial motion in response to axial motion of the piston assembly.

16. The mud pulser system of claim 15, wherein a pressure at the upstream region is greater than a pressure at the downstream region.

17. The mud pulser system of claim 15, wherein the poppet is configured to move axially towards the flow line orifice when the control valve is opened.

18. The mud pulser system of claim 15, wherein the piston assembly is configured to move axially away from the flow line orifice when the control valve is closed.

19. The mud pulser system of claim 15, wherein the magnet is disposed at a poppet of the piston assembly and the coil is disposed at a flow line orifice of the housing.

* * * * *